US005509838A

United States Patent [19]

Breivik et al.

[11] Patent Number: 5,509,838

[45] Date of Patent: Apr. 23, 1996

[54] LOADING/UNLOADING BUOY

[75] Inventors: Kare Breivik, Tau; Arne Smedal, Farvik; Kare Syvertsen, Arendal, all of Norway

[73] Assignee: Den Norske Stats Oljesplskap A.S., Stav Anger, Norway

[21] Appl. No.: 244,440

[22] PCT Filed: Mar. 30, 1992

[86] PCT No.: PCT/NO92/00056

§ 371 Date: Aug. 8, 1994

§ 102(e) Date: Aug. 8, 1994

[87] PCT Pub. No.: WO93/11033

PCT Pub. Date: Jun. 10, 1993

[30] Foreign Application Priority Data

Nov. 27, 1991 [NO] Norway ..... 914652

[51] Int. Cl.[6] ..... B63B 27/34

[52] U.S. Cl. ..... 441/5; 114/230; 114/293

[58] Field of Search ..... 441/3–5; 114/230, 114/293; 141/388; 185/261

[56] References Cited

U.S. PATENT DOCUMENTS

| | | | |
|---|---|---|---|
| 4,130,076 | 12/1978 | Bilderbeek | 441/5 X |
| 4,490,121 | 12/1984 | Coppens et al. | 441/5 |
| 4,604,961 | 8/1986 | Ortloff et al. | 441/5 X |
| 4,618,173 | 10/1986 | Dopyera | 285/261 |
| 4,892,495 | 1/1990 | Svensen | 441/5 |
| 5,044,297 | 9/1991 | De Baan et al. | 114/293 |
| 5,339,760 | 10/1994 | Korsgaard | 114/293 X |

FOREIGN PATENT DOCUMENTS 2656274 6/1991 France .

*Primary Examiner*—Sherman Basinger
*Attorney, Agent, or Firm*—Jon Carl Gealow; Keck, Mahin & Cate

[57] ABSTRACT

A buoy for use in loading or unloading a flowable medium, especially oil from a vessel at sea. The buoy includes an outer buoyancy member having a conical shape, and a central member, rotatably mounted in the outer member which forms a passage for the flowable medium from the lower end of the buoy which is connected to a transfer line to a delivery system within the vessel. The outer member is received and locked in a conical shaped opening in the bottom of the vessel which is connected to a receiving space which extends up to the deck of the vessel. The outer member forms a seal with the lower end of the opening to seal the sea off from the receiving space. The central member, has a relatively small mass and a small inertia, such that the outer buoyancy member together with the vessel may readily turn thereabout.

16 Claims, 7 Drawing Sheets

LOADING/UNLOADING BUOY

BACKGROUND OF THE INVENTION

1. Field of the Invention

The invention relates to a buoy for use in loading or unloading of a flowable medium, especially oil, the buoy at its lower end being arranged for connection to at least one transfer line and further is arranged to be introduced into a submerged downwardly open receiving space in a floating vessel, and the buoy in operation forming a transfer connection between the transfer line and a tube system on the vessel.

2. Background Information

There are previously known various buoy structures of the type which, in operation, is introduced into a submerged downwardly open receiving space at the underside of a vessel. As an example, reference may be made to U.S. Pat. No. 4,604,961 (corresponds to NO patent specification No. 167,906). This patent shows a vessel having a releasable mooring system wherein the vessel has a through-going deck opening in a central region of the vessel, the lower part of the through opening forming the submerged receiving space for a mooring element in the form of a submerged buoy. In the receiving space there is arranged a rotating body (turret) which is rotatably mounted in the hull of the vessel and is designed for receipt and attachment of the mooring element, the latter to this end being provided with a hydraulically actuated locking mechanism for attachment to the rotating body. Further, the vessel is provided with a derrick for the lowering of a retrieval string having a retrieval connector at its lower end for interconnection with the mooring element, so that this may be pulled up and into the receiving space. The interconnection is obtained in that the mooring element is provided with a conical centering receptacle having a socket arranged at the bottom wherein the retrieval connector may be received and secured, e.g. by means of a bayonet lock. The lower end of the retrieval string preferably is provided with sonar and TV equipment to ensure positioning of the retrieval connector in the centering receptacle.

Said rotating body, which is mounted in the hull of the vessel, allows the vessel to turn in relation to the anchored buoy also after establishment of the connection, under the influence of e.g. wind, current and waves. Since the rotating body is attached to the vessel under water, this requires divers for inspection and minor maintenance. Major maintenance requires docking of the vessel. Because of the fact that the rotating body is mounted to the vessel, there arise large frictional forces which are to be overcome by torques from the mooring element. These torques are relatively large due to the large outer diameter of the rotating body, and this results in correspondingly large loads. Further, it may result in uncontrolled rotation of the system because of large inertial forces, so that it becomes necessary to use a braking system for retaining the rotating body. In case of desired rotation the braking system is then released, and the rotating body is rotated in a controlled manner by means of active drive.

Further, the known system has a small ability to absorb moments caused by the horizontal mooring forces, something which results in a substantial risk for jamming actions in the mounting arrangement.

The hydraulically actuated locking mechanism which is arranged on the mooring element requires divers for connection of the control hydraulics. Diver operations in connection with connection and disconnection render the use of the system as a transport system impossible, when using shuttle tankers. Further, there is a big risk for faulty operation and damages in case of uncontrolled disconnection. In case of breakage of the hydraulic system there is no possibility for the connection of a back-up or auxiliary device.

It is an object of the invention to provide a loading/unloading buoy which makes it possible to carry out connection and disconnection between vessel and buoy in a quick and simple manner, even in bad weather.

Another object of the invention is to provide a buoy which may remain connected to the vessel in all weathers, a quick disconnection being able to be carried out if a weather limitation should be exceeded.

A further object of the invention is to provide a buoy giving a small diameter of the support means enabling turning of the vessel, so that there is obtained a small rotational resistance and a small rotary mass, and consequently no need for braking or active control of the rotary system.

A still further object of the invention is to provide a buoy which has a relatively simple and inexpensive construction, which gives a simple installation and dismantling, and which in addition gives the possibility to carry our repairs and replacement of parts on board the vessel, without disconnection of the buoy.

SUMMARY OF THE INVENTION

The above-mentioned objects are achieved with a buoy of the introductorily stated type which, according to the invention, is characterized in that it comprises an outer buoyancy member which is arranged for releasable locking to the receiving space of the vessel by means of a locking mechanism arranged therein, and centrally in the outer member a rotatably mounted member which forms a passage for medium and which at its ends is arranged for connection to the transfer line and the tube system on the vessel, respectively, and that the buoy at its upper end is connected to a means for hoisting and introducing the buoy into the receiving space of the vessel.

In an advantageous embodiment of the buoy according to the invention the outer buoyancy member consists of an upper and a lower at least partly essentially conically shaped member, the upper cone member comprising a collar having a downwards facing annular abutment edge for engagement with locking elements in the locking mechanism of the receiving space.

In the present buoy the vessel is rigidly attached to the outer buoyancy member of the buoy and is rotatable about the rotatably mounted central member, so that the buoy itself is a rotating body. The central member has a relatively small mass and a small inertia, so that a good turning stability is obtained with turning of the outer buoyancy member together with the vessel in question in the receiving space of which the buoy is connected.

The buoy has a construction which gives a simple installation and dismantling, and correspondingly low costs. It is envisaged that the weight of the buoy will be in the range of 30–50 tons. Since the buoy is of the submerged type wherein the buoy, when it is not in use, floats at a suitable depth below the water surface, there is also obtained the advantage that the buoy will not be damaged or represent any danger to seagoing traffic.

The invention will be further described below in connection with a exemplary embodiment with reference to the drawings, wherein

DESCRIPTION OF THE PREFERRED EMBODIMENTS

Figure 1:
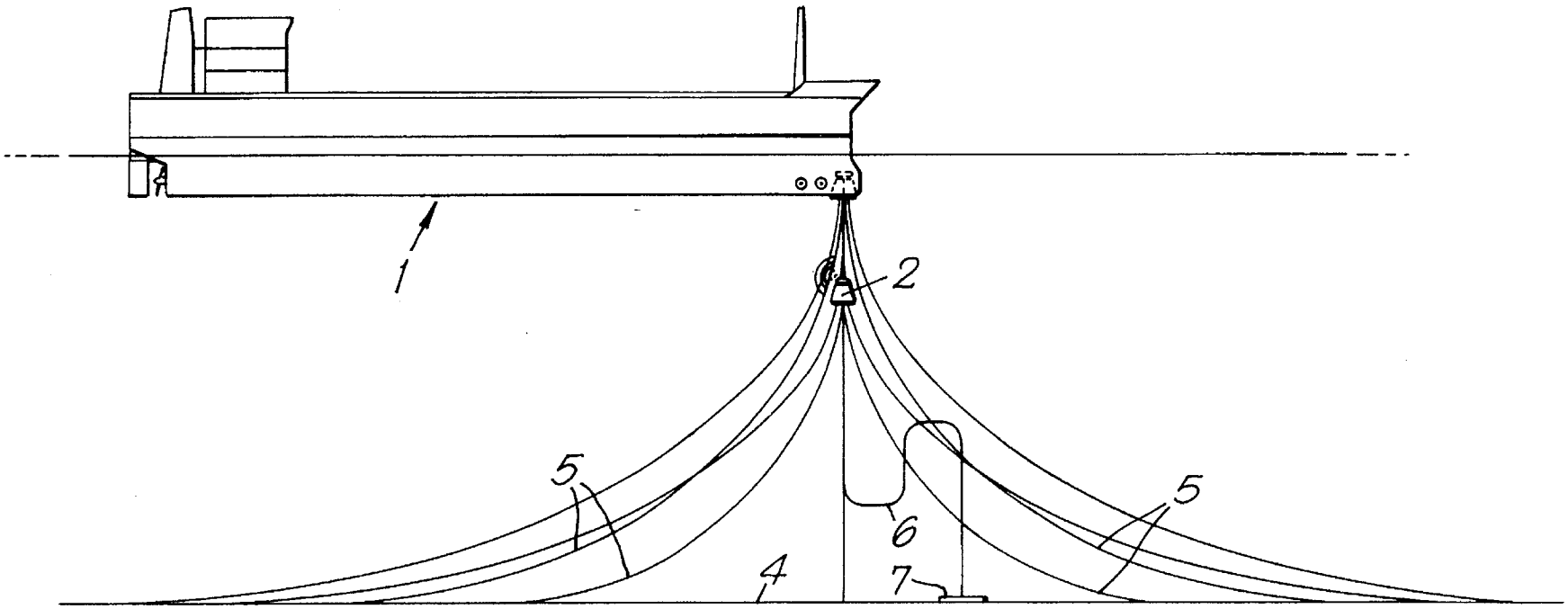
FIG. 1 shows a view of a vessel and an anchored buoy, wherein the buoy is shown in a submerged position of equilibrium as well as in a connected condition.

In the various drawing Figures corresponding members and elements are designated by the same reference numerals.

Before the buoy according to the invention is described, the utilized buoy loading system will be briefly described with reference to FIGS. 1 and 2.

Figure 2:
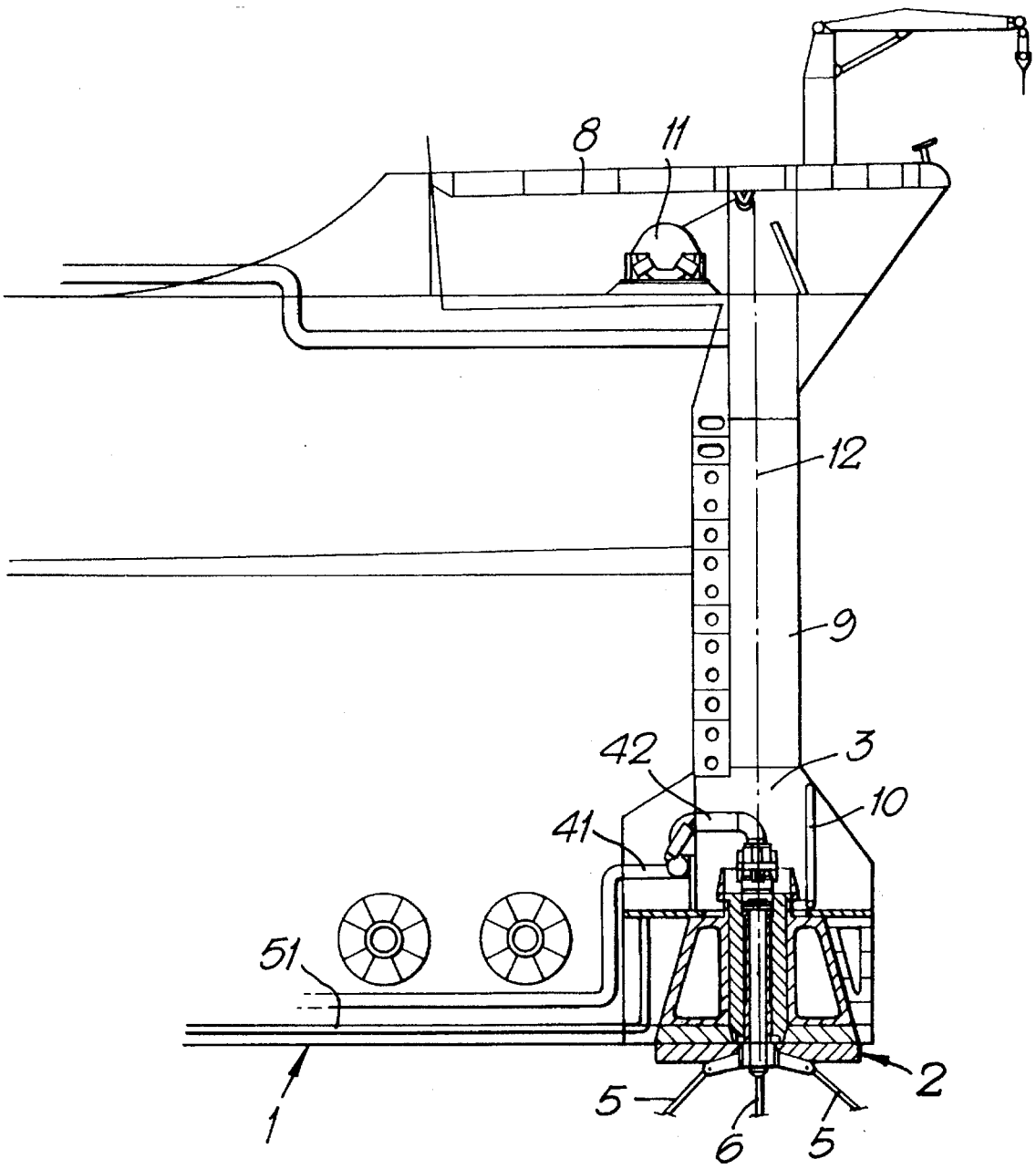
FIG. 2 shows a schematic side view of a part of a vessel having a receiving space receiving a buoy according to the invention.

As shown in FIGS. 1 and 2, the system comprises a floating vessel 1 and a buoyancy unit or buoy 2 which is to be connected to the vessel in a receiving space 3 arranged therein and which will also be designated "module". The vessel is a tanker, for example a so-called shuttle tanker, and the buoy is a loading/unloading buoy for the transfer of a flowable medium to or from tanks (not shown) on board the vessel. Normally, the flowable medium will be hydrocarbons (oil or gas), but the expression "flowable medium" here must be construed in a wide sense, since it may also be the question of other flowable materials, also in powder or particle form.

As shown in FIG. 1, the buoy 2 is anchored to the sea bed 4 by means of a suitable number of mooring lines 5 extending as catenary lines between the buoy 2 and suitable anchoring points at the sea bed 4. Each of the mooring lines may consist only of a chain, especially at smaller water depths. Generally, however, it is convenient that each of the mooring lines consists of a chain (partly resting on the sea bed) combined with an upper wire, an elastic hawser or the like, with or without buoyancy buoys (not shown) which may e.g. be placed in the connecting point between the chain and the wire, so that, for the anchoring system, there is obtained a suitable stiffness/characteristic which is adapted to the vessel and water depth in question. Thereby it is achieved that the buoy can be executed in a standard design, independent of the water depth. When the buoy 2 floats in the sea in the lower position in FIG. 1, its buoyancy will be in equilibrium with the forces from the anchoring system, so that the buoy will float at a predetermined desired depth under the water surface, where it will not be damaged or represent any danger to seagoing traffic.

The buoy 2 is coupled to a transfer line 6 in the form of a flexible riser which is shown to extend between the buoy and a station 7 suggested at the sea bed. This station for example may be an installation for the supply or storage of oil, but generally symbolizes a place communicating with the buoy 2 in order to deliver flowable medium to or receive flowable medium from the buoy. In connection with e.g. offshore oil and gas production, the station 7 normally will be located at the sea bed. However, in other applications it may be located at another place, for example in sheltered waters or on land. In such a case the buoy possibly may be "anchored" only by means of the flexible transfer line. Possibly, more than one transfer line may be connected to the buoy. It is also conceivable that the transfer line, or several transfer lines, is/are connected to a "station" in the form of a corresponding submerged buoy.

In the vessel 1 shown in FIG. 2, the receiving space 3 is arranged in the lower part of the bow of the vessel 1. The receiving space 3 is connected with the deck of the vessel through an access or service shaft 9. Further, in the receiving space 3, there is arranged a shutter 10 for shutting off the service shaft 9 and the upper part of the receiving space from the sea when the receiving space is not in use, i.e. when it does not receive a buoy 2. Among other things, this gives a possibility for inspection of equipment fitted in the shaft and the upper part of the receiving space.

In the deck area of the vessel there is arranged a hoisting means in the form of e.g. a winch 11 having a suitable line which can be lowered through the shaft 9 and the receiving space 3 and connected with the buoy 2, so that this can be hoisted up and moved in place in the receiving space 3. In FIG. 2 said line is only suggested with a dash-dotted line 12, the buoy 2 here being shown after having been hoisted up and moved in place in the receiving space 3 by means of the line and the hoisting means. The method and the system for connecting the buoy to the vessel do not constitute a part of the present invention. For a further description of this aspect of the system, and also of the vessel, reference is made to the simultaneously filed international patent applications Nos. PCT/NO92/00053 and PCT/NO92/00055.

Figure 3:
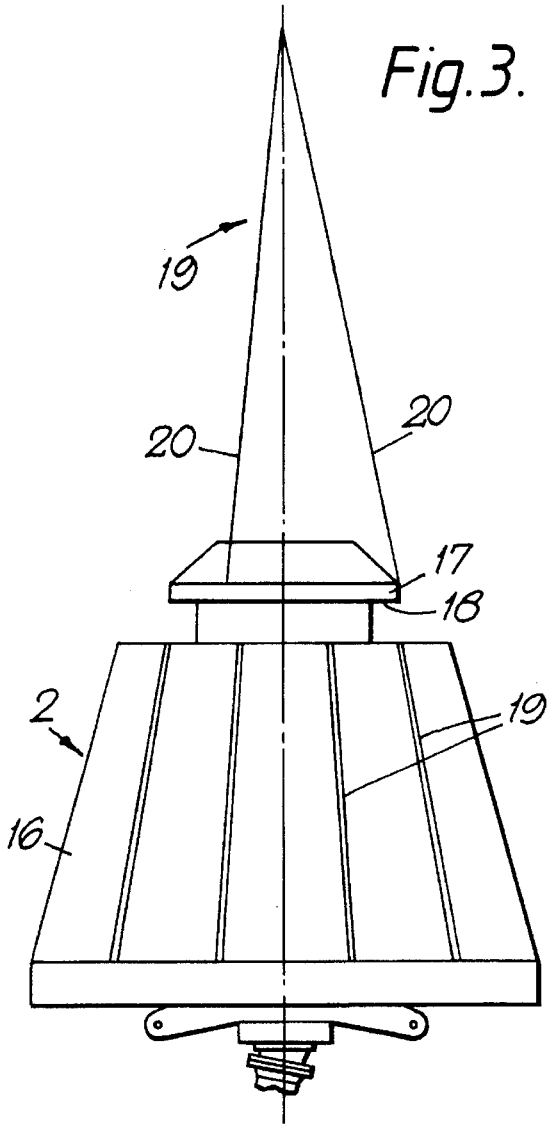
FIGS. 3 and 4 show two embodiments of buoys according to the invention.
Figure 4:
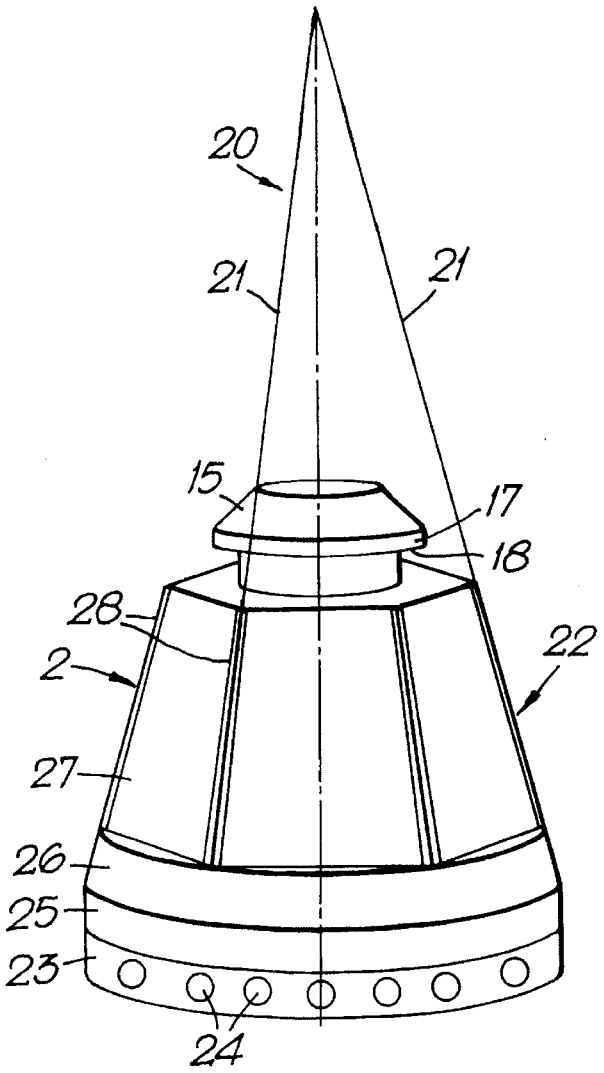
Figure 5:
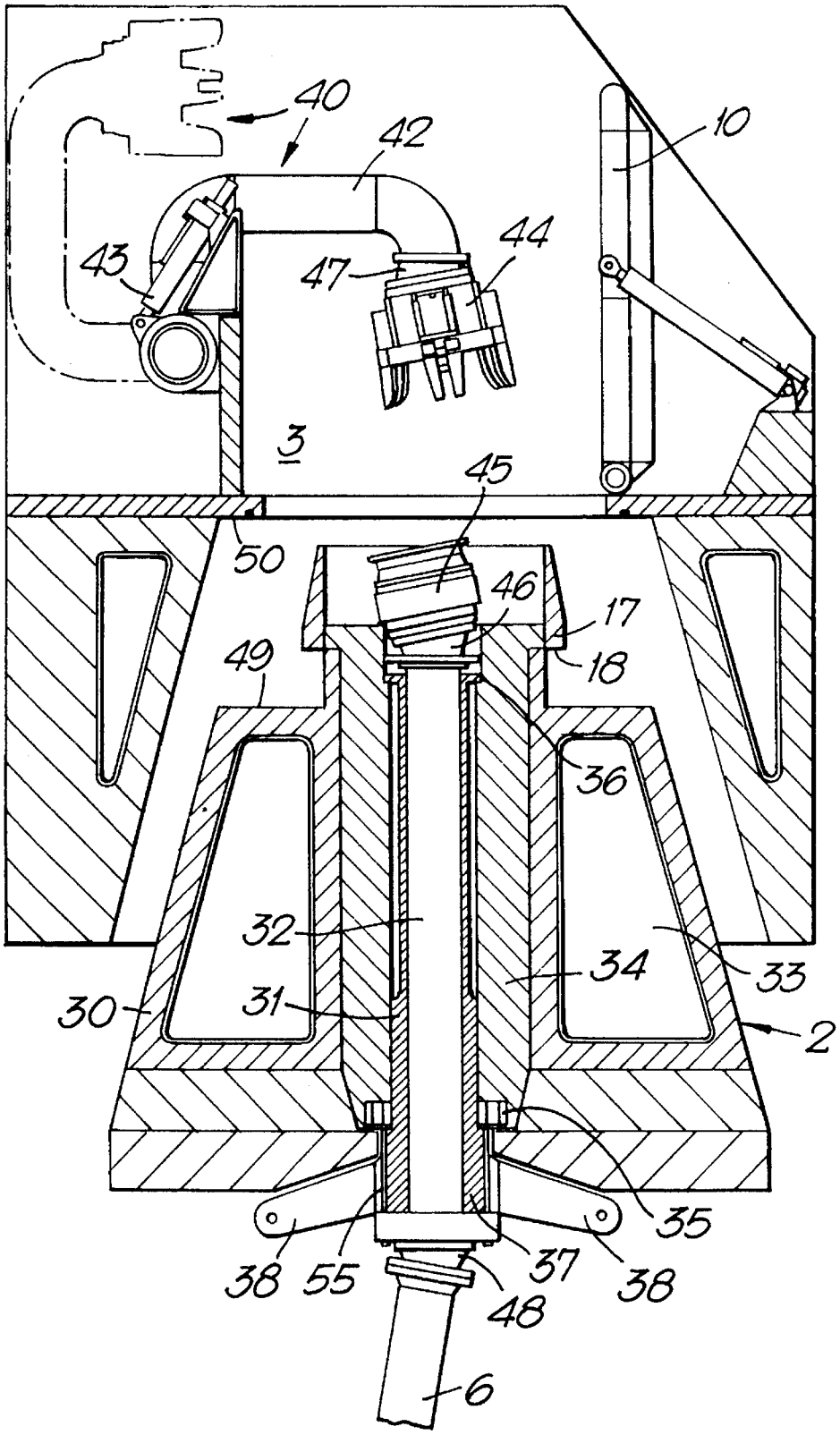
FIG. 5 shows a sectional side view of an embodiment of a receiving space in a vessel and a buoy adapted thereto.
Figure 6:
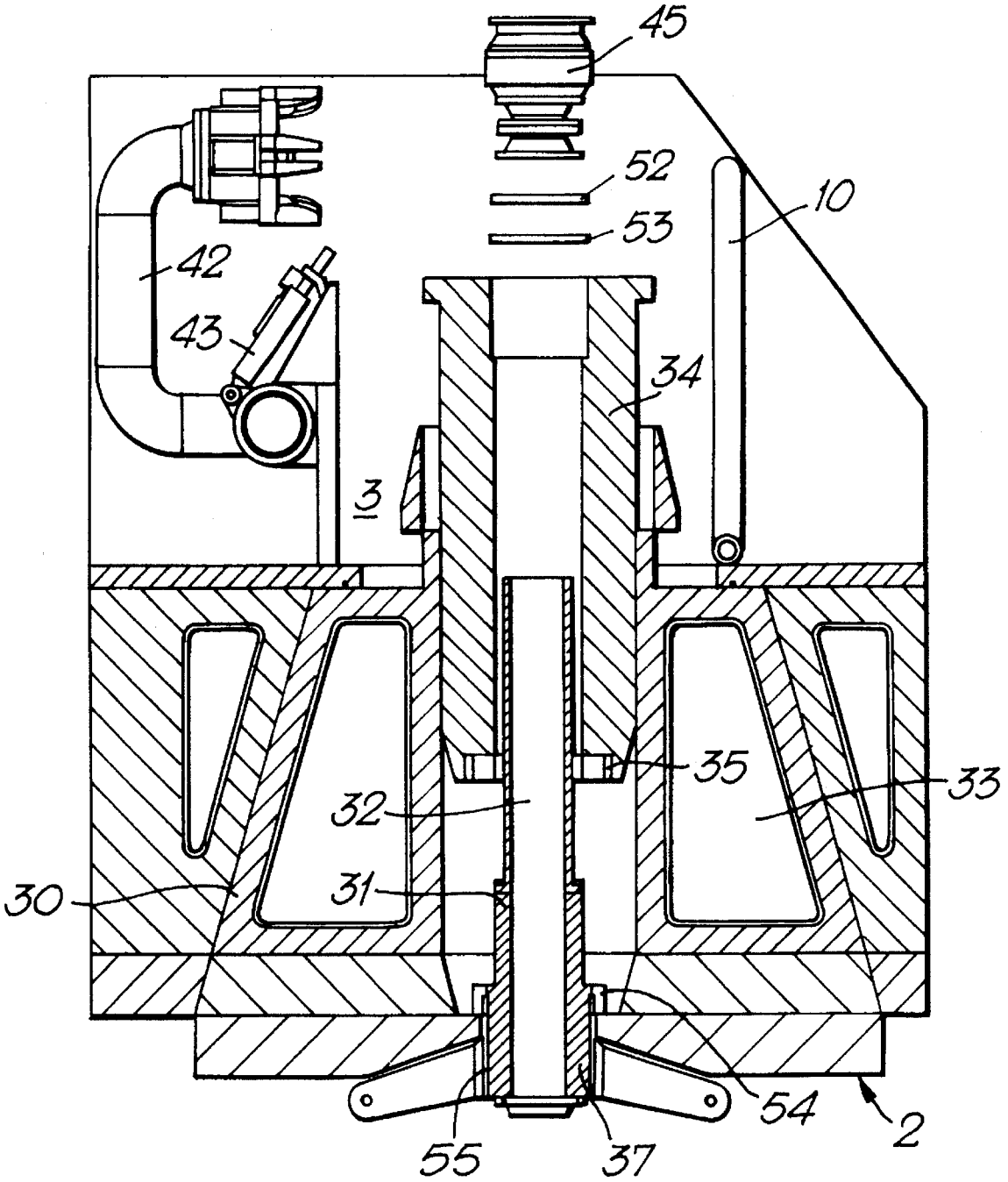
FIG. 6 shows a similar view as in FIG. 5, wherein parts of the buoy are partly dismantled.

Two examples of the external design of the buoy 2 are shown in FIGS. 3 and 4. The buoy has an at least partly downwardly essentially conically enlarged or diverging shape, to mate with a correspondingly shaped receiving space, as shown in FIGS. 2, 5 and 6. In the embodiment in FIG. 3 the buoy comprises an upper and a lower cone member 15 and 16, respectively, and the upper cone member 15 comprises a collar 17 having a downwardly facing annular abutment edge 18 for engagement with locking elements forming part of the locking mechanism arranged in the receiving space 3 for locking of the buoy 2. At its outer surface the buoy is shown to be provided with longitudinally extending guide ribs or guide edge parts 19. Preferably, these are replaceable, so that they may be replaced when there is a need for this because of wear or damage.

Further, the buoy is provided with a so-called lifting bridle 20 which is fastened to the upper member 15 of the buoy and consists of one or more lines 21 (in the illustrated case three lines, the two lines to the left in the Figure being coincident) forming a conical contour forming an upper continuation of the outer cone shape of the buoy. The lifting bridle at its upper end, for example by way of a not illustrated yoke, is connected to the line for hoisting and introduction of the buoy into the receiving space of the vessel. This arrangement is advantageous for contributing to the buoy, in the initial phase of its introduction into the receiving space, being inserted in a safe and correct manner. The final orientation of the outer buoyancy member of the buoy which, before the locking in the receiving space, is freely rotatable in relation to the moored, central member of the buoy, is, by means of the lines of the lifting bridle during the final phase of the hoisting and fitting-in in the receiving means, rotated to a position giving free connection access for the coupling tube arranged in the receiving space (see FIGS. 5–7). The desired rotation may be achieved by means of a guide edge or a roller means in the upper part of the inner space of the receiving means.

The conicity of the mating members of the buoy and the receiving space must be so large that the buoy does not jam in the receiving space, and such that the buoy is able to tilt out of the receiving space even if the buoy should stick at the lower edge on one side. With other words, the buoy must have a width/height ratio which is sufficiently large (W/H>1) to ensure that the buoy, under the occurring load forces, automatically loosens from the receiving space when releasing the locking elements of the locking mechanism.

In the embodiment shown in FIG. 4, the lower member 22 of the buoy 2 has a shape which is different from the lower "cone member" 16 in FIG. 3. Thus, the lower member 22 comprises a lower cylindrical portion consisting of a so-called "rolling edge" 23 having holes 24 to increase the viscous damping during the hoisting of the buoy, and a buoyancy element 25, and an upper conical portion consisting of a lower conical part 26 and a polygonal part 27 in the form of a truncated polygonal pyramid. The conical part 26 is arranged and dimensioned to transfer the occurring horizontal forces from the anchor lines, whereas the pyramid part is made polygonal in order for the edges to contribute to increasing the viscous damping during the hoisting of the buoy. The pyramid faces may be straight or planar as shown, but they may also be concave. Also in this embodiment there are provided longitudinally extending guide edge or wear edge parts 28 which may be replaced when needed.

It will be clear that one may also conceive of other buoy design which, for example, may represent combinations of the embodiments of FIGS. 3 and 4. The lower cone member of the buoy may e.g. consist of a lower conical part corresponding to the part 26 in FIG. 4, and an upper conical part comprising an outer layer of a suitable buoyancy material, such as foamed plastic or a cast glass fibre body, which is reinforced by a supporting structure in the form of longitudinally extending guide edge parts which are distributed along the periphery, as in FIG. 3.

The structure of the buoy and its cooperation with equipment in the receiving space 3 is further shown in the longitudinal sectional view in FIG. 5. As shown, the buoy 2 consists of an outer buoyancy member 30 and a central member 31 which is rotatably mounted in the outer member and has a through-going passage 32 for medium to be transported via the buoy. When needed, the central member may comprise several such passages. The outer member is divided into several water-tight buoyancy chambers 33. Some of these may be arranged to be filled with ballast, in order to be able to adjust the buoyancy of the buoy. There will then be provided for means for removing such ballast, either automatically, for example by means of compressed air, or manually.

Further, the outer member 30 comprises a central replaceable bearing support member 34 having a lower radial bearing 35 and an upper axial bearing 36 for the central member 31. When needed, the bearing support member 34 may be lifted up from the outer buoyancy member 30 for inspection and possible replacement of parts, as mentioned in connection with FIG. 6.

The central member 31 is provided with a lower reinforced portion 37 having a number of outwardly projecting arms 38 for attachment of the mooring lines 5 of the buoy (not depicted in FIG. 5).

In the upper part of the receiving space 3 there is arranged a coupling unit 40 which is associated with a tube system 41 (see FIG. 2) for medium transfer arranged on the vessel. The coupling unit comprises a coupling tube 42 which, by means of a hydraulic cylinder 43, is pivotable between a stowed position and a connecting position (both positions shown in FIG. 5), one end of the tube being provided with a coupling head 44 for connection to the upper end of the central member 31 of the buoy when the buoy is in place in the receiving space. This connection takes place through a swivel means 45 which, in the illustrated embodiment, is coupled to the central member 31 through a flexible joint 46. Also the coupling head 44 comprises a flexible joint 47. The illustrated embodiment also contains a third flexible joint 48 which is arranged between the lower end of the central member and the transfer line 6 of the buoy. The flexible joints may, for example, be ball joints. The flexible joints 46 and 47 especially are arranged for accommodating dimensional tolerances when connecting the buoy 2 to different vessels, whereas the flexible joint 48 provides for moment-free transfer of forces from the transfer line 6 to the buoy, and in addition facilitates the positioning of the buoy relative to the receiving space 3, so that the buoy slides easily in place therein. Instead of ball joints other types of flexible joints could be used.

When the buoy 2 is locked in place in the receiving space 3, an upper abutment surface 49 on the outer member 30 of the buoy is brought into sealing abutment against a sealing flange 50 between the upper and lower parts of the receiving space 3, so that the upper part of the receiving space and the service shaft 9 are shut off from the sea. The receiving space and the shaft then may be emptied of water, the receiving space being connected to a drainage conduit 51 for this purpose, as shown in FIG. 2. The bearing support member 34 then may be lifted up from the outer member 30, as shown in FIG. 6, while the buoy is in place in the receiving space. When the bearing support member is lifted up, it brings with it the parts mounted at the upper end of the central member 31, i.e. the swivel means 45 with the ball joint 46, and also the axial bearing 36 and associated intermediate rings 52, 53 may be dismantled and replaced. Also the radial bearing 35 is brought along by the supporting member 34 when this is lifted up. A collar 54 is fastened to the reinforced portion 37 of the central member 31 by means of bolts 55, and this collar comes into sealing abutment against a bottom edge portion of the buoy when the bearing support member 34 is lifted up, so that a seal against ingress of sea water is formed.

In practice the receiving space 3 and the service shaft 9 will be equipped with suitable sensors and TV cameras for monitoring and control purposes. There will also be arranged pumping equipment for drainage purposes, etc.

Figure 7:
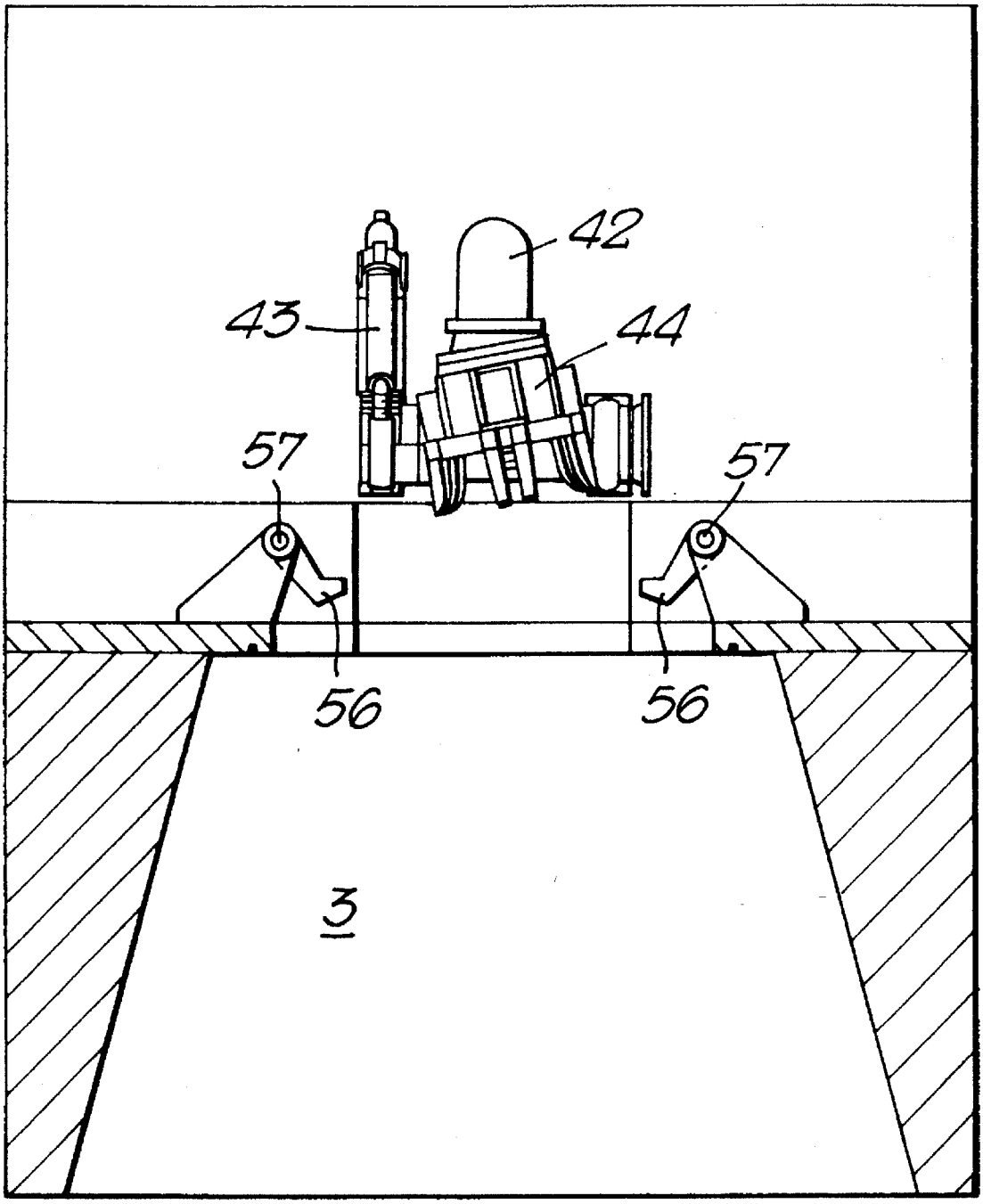
FIG. 7 shows a schematic sectional view of the receiving space in FIG. 6, at right angles to the sectional plane in FIG. 6.

The locking mechanism for releasable locking of the buoy 2 when it is in place in the receiving space 3, is schematically shown in FIG. 7. In the illustrated embodiment the mechanism comprises a pair of locking dogs 56 which are actuated by a hydraulic system and are rotatable about horizontal axes 57 at diametrically opposite sides of the receiving space 3. The hydraulic actuators (not shown) for operation of the locking dogs may, e.g., be hydraulic cylinders. When activating the locking dogs 56, these will pivot in a vertical plane into engagement with the downwards facing abutment edge 18 of the upper cone member of the buoy. The hydraulic cylinders suitable are connected in parallel to the hydraulic drive system, such that they automatically compensate for possible unevennesses in the abutment edge. The locking dogs 56 provide for rigid locking of the outer buoyancy member 30 of the buoy to the receiving space 3, and the vessel then is allowed to turn about the rotatably mounted central member 31, the swivel means 45 allowing such turning after the coupling tube 42 having been coupled to the buoy. Preferably, the hydraulic actuators are arranged to actuate a mechanical locking means (not shown), so that the buoy is kept securely in place in the locked position, also in case of failure in the hydraulic system.

Figure 8:
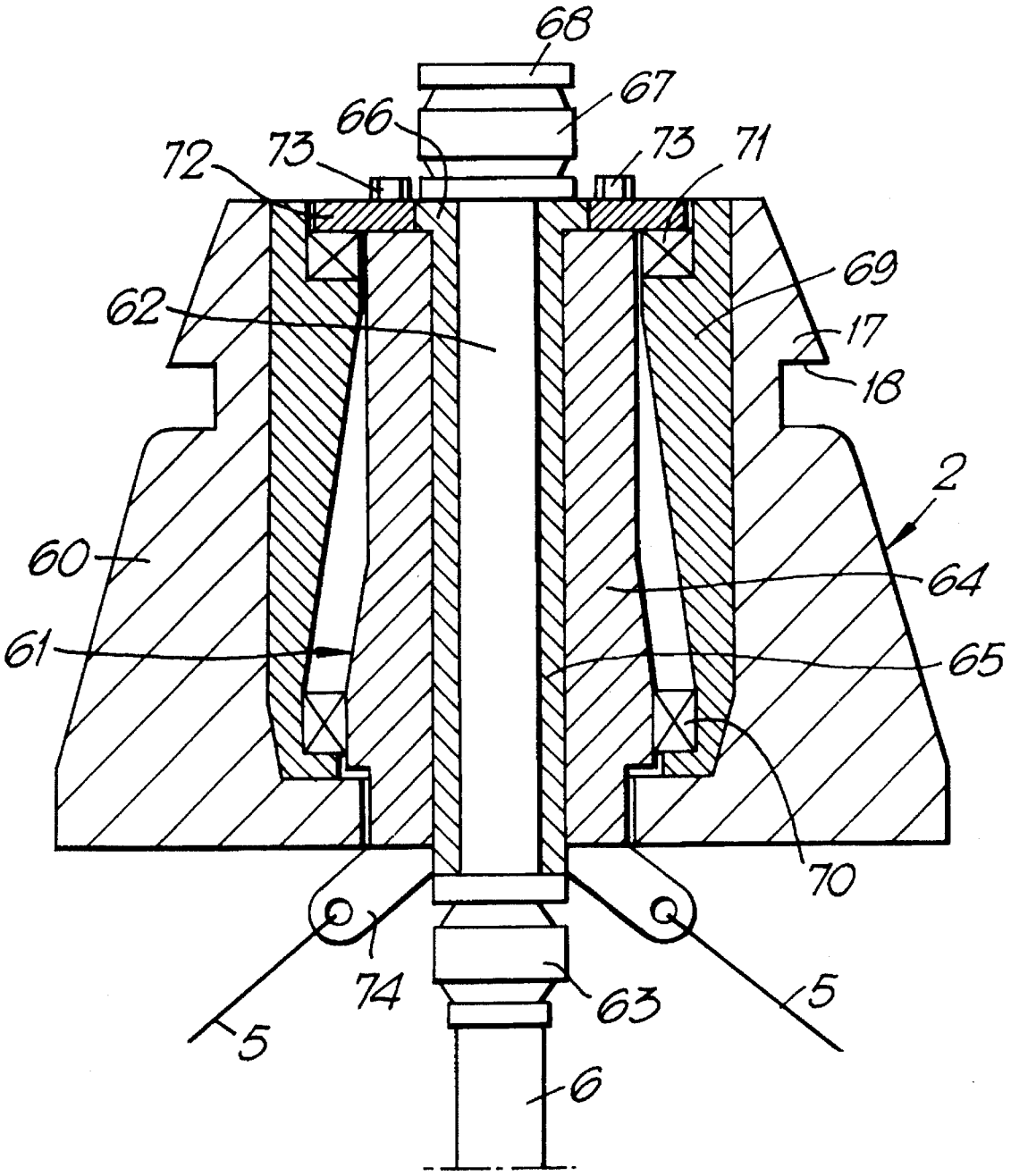
FIG. 8 shows a sectional view of an additional embodiment of a buoy according to the invention.

FIG. 8 shows a further embodiment of a buoy according to the invention. The buoy 2 comprises an outer buoyancy member 60 and a rotatably mounted central member 61 having a passage 62 for medium, but the central member here is executed in the manner that also the flexible joint 63 arranged under the buoy and the connected transfer line 6 may be pulled up from the buoy for inspection and maintenance. The central member consists of an essentially tubular bearing member 64 enclosing a tube member 65 forming said passage 62 and to the lower end of which the flexible joint 63 and the transfer line 6 are connected. The tube member 65 at its upper end is formed with a pulling-up flange 66 to which a flexible joint 67 having a connecting flange 68 is connected. The bearing support member here consists of a pulling-up frame 69 carrying a lower radial bearing 70 and an upper axial bearing 71. An annular bearing abutment plate 72 is fastened to the top of the bearing member 64 by means of bolts 73, and further the bearing member at the bottom is formed with outwardly projecting arms 74 for attachment of the mooring lines 5 of the buoy. The bearing pulling-up frame 69 with the bearings 70 and 71 may be pulled up after removal of the bearing abutment plate 72.

In the illustrated embodiment the central tube member 65 together with the flexible joint 63 and the transfer line 6 may be pulled up to the deck area of the vessel when needed. Water then will flow into the upper part of the receiving space 3 and the shaft 9. After inspection and possible repair, the pulled-up parts may be lowered through the water within the shaft and the receiving space, said members being pulled downwards because of the weight of the transfer line 6, such that the central tube member is moved in place in the buoy. The shaft and the receiving space thereafter may be emptied of water if this is desired.

We claim:

1. A buoy adapted for reception in a submerged downwardly open receiving space in a floating vessel for transfer of a flowable medium between a transfer line connected to said buoy and a tube system within said vessel, said buoy comprising:

an outer buoyancy member, means on said outer buoyancy member engageable by latch means within said receiving space for releasable securement of said buoy within said receiving space, at least a part of the outer shape of said outer buoyancy member being complementary to the inner shape of said receiving space, for forming a seal from the surrounding sea when said outer member is engaged in said space, an inner member, comprising a tubular hollow shaft providing a passage for the flowable medium, means rotatably mounting said inner member centrally in said outer member, first and second connection means at respective ends of said passage for connection respectively to said transfer line and to said tube system, and means on said buoy whereby said buoy can be hoisted into said receiving space by a line lowered therefrom.

2. The buoy of claim 1 wherein a lower portion of said outer buoyancy member has a polygonal circumferential surface.

3. The buoy of claim 1 wherein a lower portion of said outer buoyancy member has an at least partially conical shape.

4. The buoy of claim 1 wherein at least a lower portion of said outer buoyancy member is divided into a plurality of water-tight buoyancy chambers.

5. The buoy of claim 1 further comprising a lower reinforced portion of said central member for attachment of mooring lines for anchoring said buoy to the sea bed.

6. The buoy of claim 1 further comprising a lower conical member adapted to transfer horizontal load forces.

7. The buoy of claim 1 having a width/height ratio sufficiently large to ensure that said buoy separates from said receiving space on release of said latch means.

8. A buoy for reception in a submerged downwardly open receiving space in a floating vessel for transfer of a flowable medium between a riser connected to said buoy and piping within said vessel, said buoy comprising:

an outer member, means on said outer member for releasable engagement by latch means within said receiving space, an elongate tubular inner member rotatably received in said outer member and having upper and lower ends, an attachment element at said lower end of said inner member for attachment of said inner member to at least one anchoring line, first connection means at said upper end of said inner member for connection with said piping, and second connection means at said lower end of said inner member for connection with said riser, whereby said flowable medium can flow within said inner member between said riser and said piping, said outer member having an outer shape at least a part of which is complementary to the inner shape of the receiving space, such that when said outer member is engaged in said receiving space, a seal is formed, for sealing said space from the surrounding sea.

9. The buoy of claim 8 wherein said first connection means comprises a swivel means adapted for connection to a coupling head included in said piping.

10. The buoy of claim 9 further comprising a flexible joint coupling said upper end of said inner member to said swivel means.

11. The buoy of claim 9 wherein said second connection means includes a flexible joint for connection to the upper end of said riser.

12. A buoy adapted to be hoisted by hoisted means into a downwardly open receiving space of a floating vessel, for transfer of a flowable medium between a riser connected to said buoy and piping of said vessel, said buoy comprising:

an outer surface tapering upwardly to function as a guide surface during entry of said buoy into said receiving space, at least a part of said outer surface being complementary to the shape of the receiving space for sealing the receiving space against the surrounding sea when the buoy is received in said space, and a lifting bridle, engageable by said hoisting means, said lifting bridle comprising at least two lines forming a continuation of said outer surface to further facilitate entry of said buoy into said receiving space.

13. The buoy of claim 12 further comprising longitudinally extending, replaceable guide edge parts at said outer surface.

14. The buoy of claim 12 wherein said outer surface comprises an at least partly conical surface corresponding to the interior of said receiving space.

15. A buoy adapted for reception in a submerged downwardly open receiving space in a floating vessel for transfer of a flowable medium between a transfer line connected to said buoy and a tube system within said vessel, said buoy comprising:

an outer buoyancy member comprising a lower portion and an upper portion of at least partly conical shape, means on said outer buoyancy member engageable by latch means within said receiving space for releasable securement of said buoy within said receiving space, said means comprising a collar having a downwardly facing annular abutment edge, an inner member, means rotatably mounting said inner member centrally in said outer member, a passage for said flowable medium extending through said inner member, first and second connection means at respective ends of said passage for connection respectively to said transfer line and to said tube system, means on said buoy whereby said buoy can be hoisted into said receiving space by a line lowered therefrom, and a bearing support member, said support member journalling said central member and being adapted to be lifted from said outer buoyancy member for inspection and servicing.

16. The buoy of claim 15 wherein said bearing support member comprises a lower radial bearing and an upper axial bearing for said central member.

* * * * *